US008917190B1

(12) United States Patent
Melvin

(10) Patent No.: US 8,917,190 B1
(45) Date of Patent: Dec. 23, 2014

(54) METHOD OF RESTRICTING TURNS AT VEHICLE INTERSECTIONS

(71) Applicant: Stephen Waller Melvin, Vancouver (CA)

(72) Inventor: Stephen Waller Melvin, Vancouver (CA)

( * ) Notice: Subject to any disclaimer, the term of this patent is extended or adjusted under 35 U.S.C. 154(b) by 172 days.

(21) Appl. No.: 13/748,554

(22) Filed: Jan. 23, 2013

(51) Int. Cl.
*G08G 1/07* (2006.01)

(52) U.S. Cl.
CPC ..... *G08G 1/07* (2013.01)
USPC ..... 340/916; 340/905; 340/907; 340/918; 701/117

(58) Field of Classification Search
CPC ..... G08G 1/00; G08G 1/01; G08G 1/02; G08G 1/07; G08G 1/085; G08G 1/08; G08G 1/082; G08G 1/096; G08G 1/096783
USPC ..... 340/916, 918, 905, 909, 907, 933, 934, 340/935, 936; 701/117, 118, 119, 301
See application file for complete search history.

(56) References Cited

U.S. PATENT DOCUMENTS

| | | | | |
|---|---|---|---|---|
| 3,394,638 | A | 7/1968 | Burrell | |
| 3,506,808 | A | 4/1970 | Riddle | |
| 3,915,580 | A | 10/1975 | Kaufman | |
| 4,370,718 | A | 1/1983 | Chasek | |
| 4,592,673 | A | 6/1986 | Lee | |
| 4,630,961 | A | 12/1986 | Hellwig | |
| 5,795,095 | A | 8/1998 | Heller | |
| 5,862,509 | A * | 1/1999 | Desai et al. | 701/411 |
| 5,921,701 | A | 7/1999 | Clayton | |
| 6,685,386 | B1 | 2/2004 | Lee | |
| 7,135,989 | B2 | 11/2006 | Parsons | |
| 7,317,406 | B2 * | 1/2008 | Wolterman | 340/917 |
| 8,629,785 | B2 * | 1/2014 | Ni | 340/907 |
| 8,825,350 | B1 * | 9/2014 | Robinson | 701/117 |
| 2007/0260392 | A1 * | 11/2007 | Paolini et al. | 701/117 |
| 2013/0325344 | A1 * | 12/2013 | Yester | 701/533 |

OTHER PUBLICATIONS

Lakkundi, V. R., Park, B., Garber, N. J. and Fontaine, M. D., "Development of Left-Turn Lane Guidelines for Signalized and Unsignalized Intersections," Research Report No. UVACTS-5-14-69, Center for Transportation Studies at the University of Virginia, Jun. 2004.

Ivan, J. N., Sadek, A. W., Zhou, H. and Ranade, S., "Warrants for Exclusive Left Turn Lanes at Unsignalized Intersections and Driveways," Report No. NETCR72, Project No. 05-7, Department of Civil and Environmental Engineering, University of Connecticut, Sponsored by The New England Transportation Consortium, Feb. 12, 2009.

Lee, J. and Park, B., "Development and Evaluation of a Cooperative Vehicle Intersection Control Algorithm Under the Connected Vehicles Environment," IEEE Transactions on Intelligent Transportation Systems, vol. 13, No. 1, Mar. 2012, pp. 81-90.

* cited by examiner

*Primary Examiner* — Anh V La
(74) *Attorney, Agent, or Firm* — Stephen W. Melvin

(57) ABSTRACT

A method of restricting turns at vehicle intersections imposes a policy that is dynamic and congestion based. Vehicle turns are allowed only to the extent that such a maneuver does not cause a hindrance to other vehicles traveling the same direction that are not turning. A hindrance may be defined in a variety of ways based on whether other vehicles are substantially impeded in their progress. In this way, such a "no hinder" turn restriction is dependent on actual driving conditions and allows for more efficient movement of traffic in both heavily congested and light driving conditions. A no hinder turn restriction may be combined with or may replace other types of turn restrictions and may be utilized for both left and right turns and for streets with single or multiple lanes.

7 Claims, 6 Drawing Sheets

LEFT TURN OK
IF NO HINDER

LEFT TURN OK
IF NO HINDER
7AM - 930AM
3PM - 6PM
MON - FRI

7AM - 930AM
3PM - 6PM
MON - FRI
OTHER TIMES:
LEFT TURN OK
IF NO HINDER

METHOD OF RESTRICTING TURNS AT VEHICLE INTERSECTIONS

FIELD OF THE INVENTION

This invention relates to the field of traffic control and more specifically to the design of at grade intersections of multiple roadways and turn restriction policies for efficient movement of vehicular traffic.

BACKGROUND

At grade intersections of streets and roads carrying vehicle traffic, such as are common in most cities in the industrialized world, impose inherent limitations on sequencing of vehicles. In the case that two such streets intersect it is common for a traffic light to sequence through two or more phases in which traffic flows alternatively along one street and then the other. Vehicles turning at such intersections impose constraints on the efficient flow of traffic. For example, if a turning vehicle must yield to oncoming traffic, which is a common rule, then vehicles behind it not turning must wait. Because of this, it is common to place restrictions on turns at intersections to promote the more efficient flow of traffic.

In some cases turns are prohibited altogether. A sign denoting a complete prohibition of left turns is shown in FIG. 1A. Another common approach is to prohibit left turns only at certain times and for certain categories of vehicles and to allow left turns at other times. A sign denoting a time and category based restriction on left turns is shown in FIG. 1B. This sign means that between the times shown on the sign (7:00 AM to 9:30 AM and 3:00 PM to 6:00 PM, Monday through Friday), left turns are prohibited. At other times, there are no restrictions and a vehicle is permitted to turn left. Buses are permitted to turn left at any time. Time based left turn restrictions tend to be based on busy commute time, i.e. "rush hour", and are an attempt to balance the inefficiency of a left turning vehicle blocking other vehicles with the desire to allow people to travel in the most direct route. Unfortunately, time based turn restrictions are imperfect solutions. Sometimes they will permit a left turn when doing so greatly reduces the safe and efficient flow of traffic and sometimes they prohibit a left turn when such a prohibition also reduces efficient traffic flow. Thus, existing approaches to turn restrictions lead to inefficient and potentially unsafe driving conditions. An improved method for imposing restrictions on vehicles turning at intersections is needed.

SUMMARY

A method of restricting turns at vehicle intersections imposes a policy that is dynamic and congestion based. Vehicle turns are allowed only to the extent that such a maneuver does not cause a hindrance to other vehicles traveling in the same direction that are not turning. A hindrance may be defined in a variety of ways based on whether other vehicles are substantially impeded in their progress. In this way, such a "no hinder" turn restriction is dependent on actual driving conditions and allows for more efficient movement of traffic in both heavily congested and light driving conditions. A no hinder turn restriction may be combined with or may replace other types of turn restrictions and may be utilized for both left and right turns and for streets with single or multiple lanes.

DETAILED DESCRIPTION

Figure 1A:
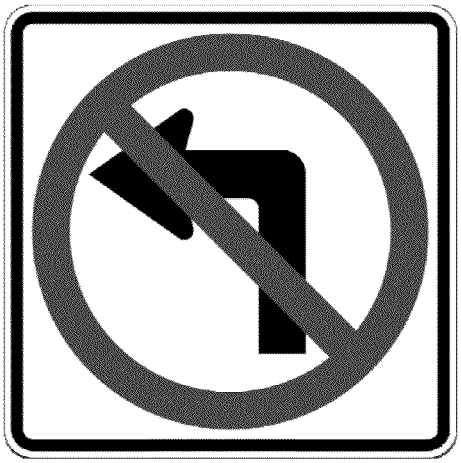
PRIOR ART Fig. 1A
FIG. 1A illustrates a prior art sign denoting a complete left turn restriction.

In regions where left-hand drive vehicles are utilized, it is common to impose left turn restrictions in at grade intersections of streets carrying vehicle traffic. This is principally due to the fact that it is a common driving rule that left turning vehicles must yield to oncoming traffic and therefore when traffic is flowing in both directions, a left turning vehicle will block vehicles behind it that are not turning left. Recognizing the inefficiency of blocking a lane of traffic for a single vehicle, a left turn restriction forces drivers wanting to turn left to make other arrangements. For example, if a driver desires to go left but left turns are prohibited they may be forced to make three right turns to accomplish their desired route. Although this imposes additional driving on the vehicle going left, in many cases it will yield an overall increase in efficiency if a small percentage of vehicles desire to turn and if congestion is heavy. FIG. 1A illustrates a prior art sign denoting a complete prohibition of left turns.

Figure 1B:
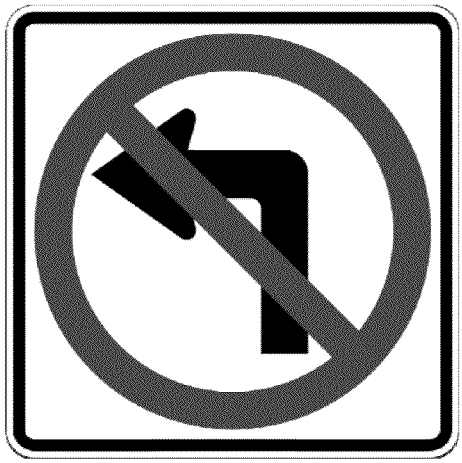
PRIOR ART Fig. 1B
FIG. 1B illustrates a prior art sign denoting a time based left turn restriction.

When traffic conditions are light however, it is more efficient to allow vehicles to take the most direct route possible. Thus, an improvement to the all or nothing approach to left turn restrictions is to prohibit left turns only at certain times. This approach attempts to balance the inefficiency of allowing left turns during heavy traffic with the inefficiency of prohibiting left turns during light traffic. Time based left turn restrictions are generally based on a prediction of when traffic is likely to be heavy and prohibiting left turns during those times. FIG. 1B illustrates a prior art sign denoting a time based restriction on left turns.

There are a number of problems with time based left turn restrictions. First, they are based on a static a priori notion of when traffic will be heavy. In certain cases there may be very light traffic during a time when left turns are prohibited. For example if a holiday falls on a weekday, then there may be no appreciable commute traffic during that day. In such a case, vehicles are unnecessarily restricted from turning when doing so would not impact traffic flow and would allow them to take a more direct route. Conversely, there may be times when traffic is very heavy outside of the prohibited times. In such cases, vehicles being permitted to turn left may significantly impact the flow of traffic by blocking many vehicles from crossing the intersection. In such a case traffic efficiency may be greatly reduced and safety may be impacted.

Figure 2A:
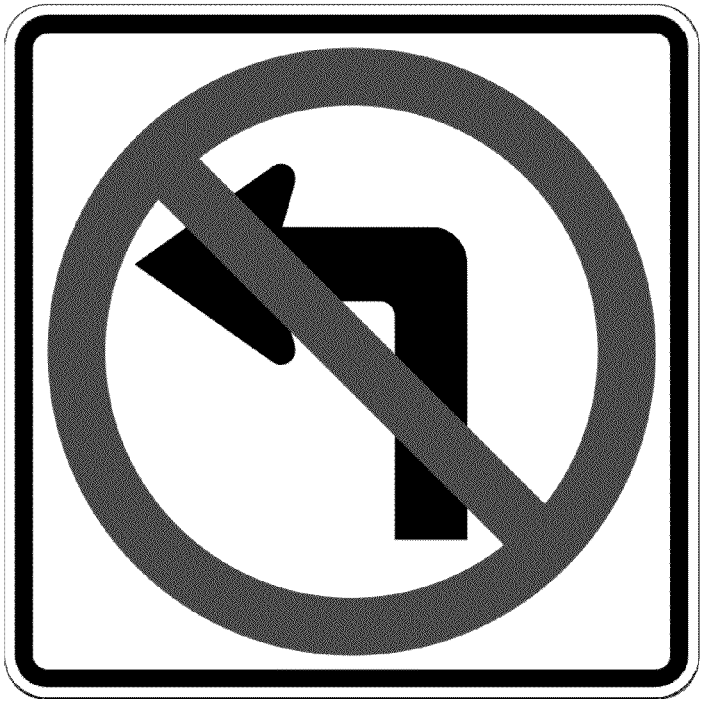
FIG. 2A illustrates a sign denoting a "no hinder" left turn restriction according to one embodiment of the present invention.

Embodiments of the present invention employ what could be called a "no hinder" turn restriction. The no hinder turn is a dynamic and congestion based policy for making turns. Fundamentally, a driver is permitted to make a no hinder turn if doing so does not cause a hindrance to other vehicles and is prohibited otherwise. In particular, if a driver desires to turn left and if doing so would dictate a wait for oncoming traffic, and if a vehicle behind is not turning left, then such a left turn is prohibited and the vehicle must continue through the intersection. It can be appreciated that there are a number of ways in which a "hindrance" can be defined in sufficiently precise terms that it would be understandable to the general public and enforceable through traffic citations and courts. FIG. 2A illustrates a sign depicting a no hinder left turn according to an embodiment of the present invention.

Figure 3:
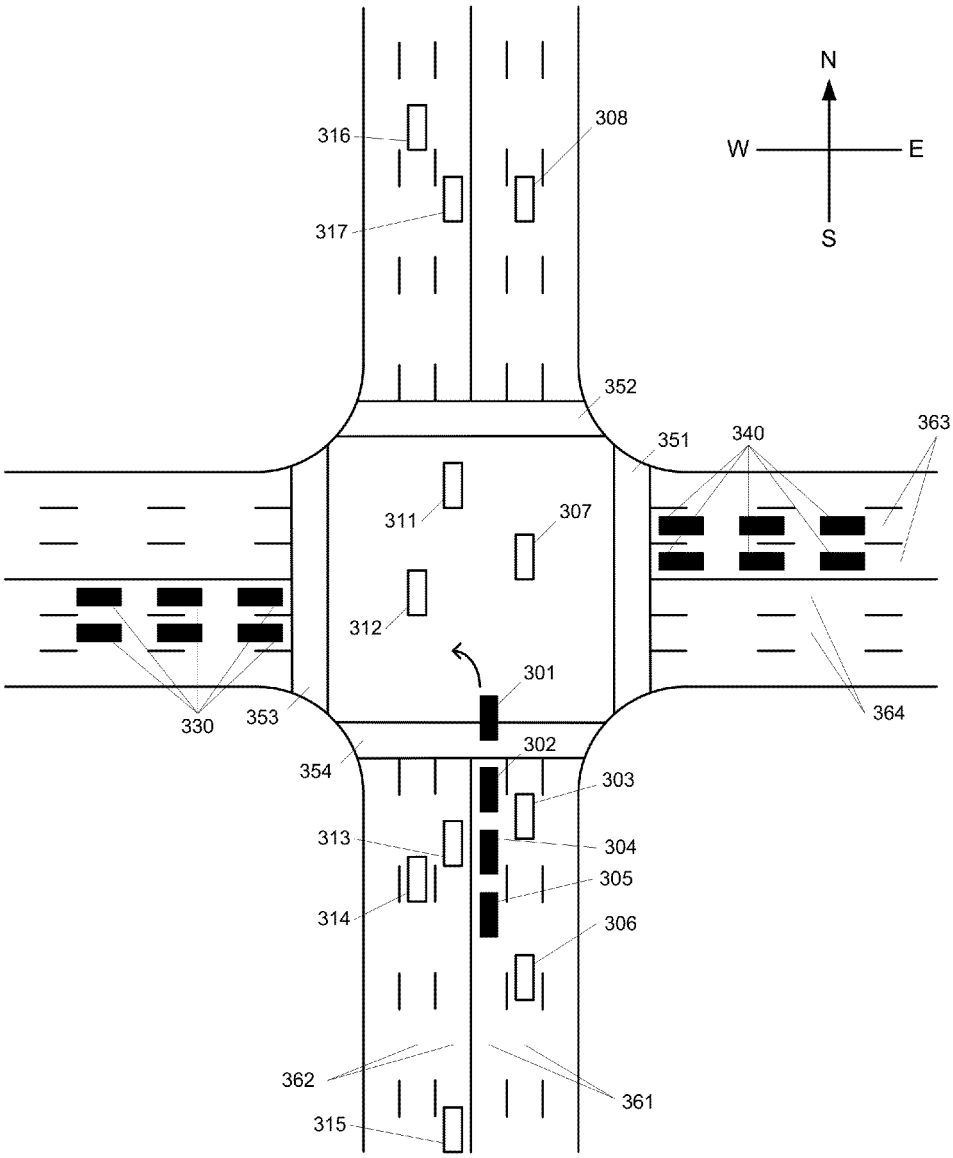
FIG. 3 illustrates a scenario at an intersection in which a vehicle turning left is hindering other vehicles.

FIG. 3 illustrates a scenario at an at grade intersection of two perpendicular streets, each with three lanes in each direction. In the scenario depicted in FIG. 3, two lanes in each direction carry traffic and the curb lane is set aside for parking, buses, right turns and/or an additional lane during commute hours. In alternative embodiments other numbers of lanes with or without a special curb lane can be utilized. FIG. 3 illustrates two northbound lanes 361, two southbound lanes 362, two westbound lanes 363 and two eastbound lanes 364 each with traffic. In the scenario illustrated in FIG. 3, vehicles 340 in the westbound lanes and vehicles 330 in the eastbound lanes are currently waiting, such as directed by a red traffic light (not shown). Conversely the northbound and southbound lanes are currently flowing, such as directed by a green traffic light (not shown). The vehicles depicted in FIG. 3 are solid for cars that are currently stopped and are depicted as hollow for vehicles that are currently moving.

In the scenario of FIG. 3, vehicle 301 desires to turn left into westbound lanes 363. However, because of oncoming traffic, specifically vehicles 313, 314 and 315, which have already passed and vehicles 312, 311, 316 and 317, which are upcoming, vehicle 301 is not able to turn left immediately and must wait. Consequently vehicles 302, 304 and 305, which desire to continue northbound, must also wait. Thus, vehicles 302, 304 and 305 are being impeded in their progress northbound by vehicle 301. Under one embodiment of the present invention, vehicle 301 would be prohibited from making this turn. Meanwhile vehicles 303, 306, 307 and 308 are moving northbound unhindered. In this case, the two northbound lanes 361 have been essentially reduced to a single northbound lane. Vehicles 302, 304 and 305 must either merge to the right to pass vehicle 301, or they must wait until vehicle 301 is able to turn left. FIG. 3 illustrates an example of a left turn causing a hindrance. FIG. 3 also depicts pedestrian walkways 351, 352, 353 and 354. In the case of vehicle 301 turning left onto westbound lanes 363, in addition to having to wait for oncoming traffic, it may also have to wait for pedestrian traffic in crosswalk 353. In alternative embodiments, eastbound and westbound lanes may consist of a single lane in each direction and there may be no traffic light but only a stop sign for those vehicles. In that case, westbound and eastbound vehicles must yield to all traffic traveling northbound and southbound.

Figure 4:
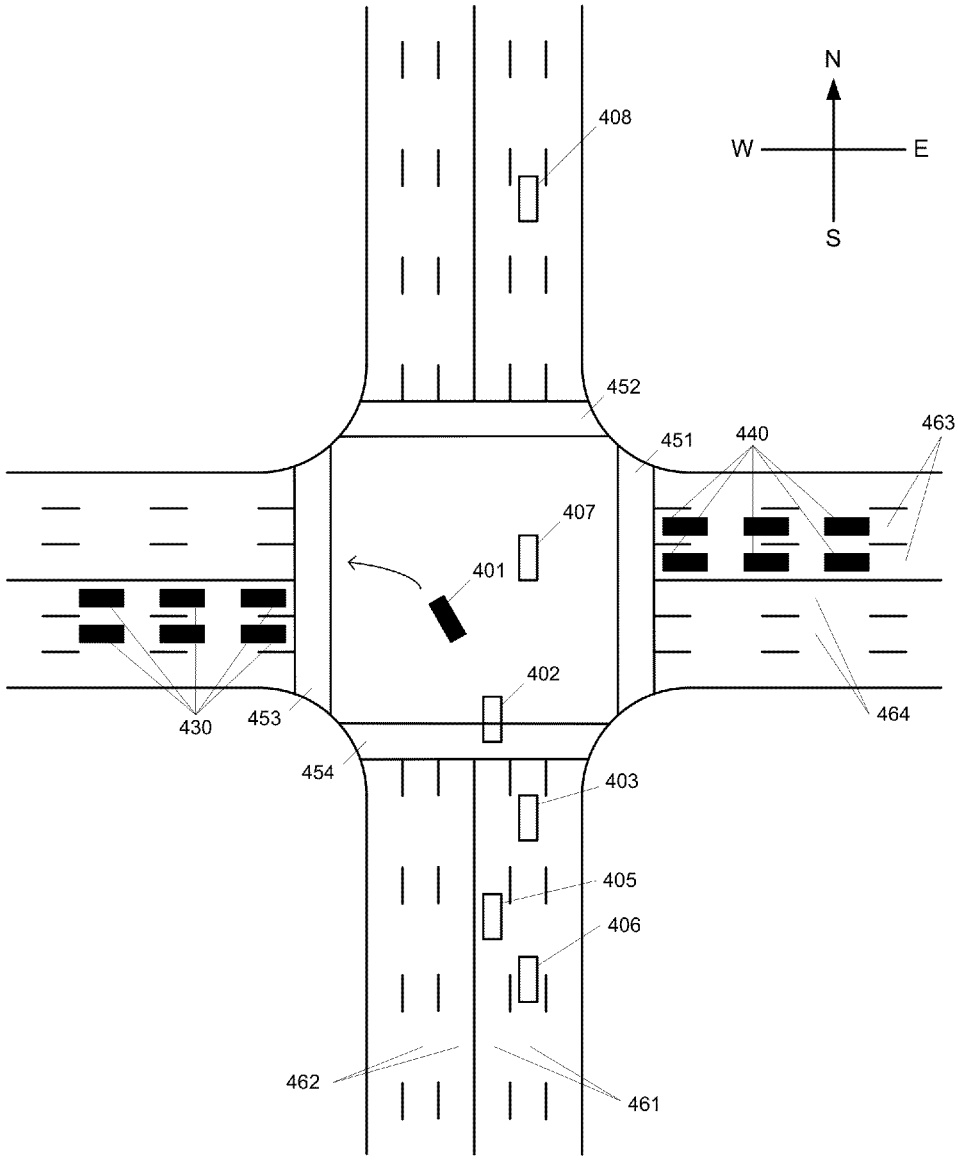
FIG. 4 illustrates a scenario at an intersection in which a vehicle is turning left without hindering other vehicles.

FIG. 4 illustrates a different scenario in an intersection of a design similar to that depicted in FIG. 3. As for FIG. 3, westbound vehicles 440 in lanes 463 and eastbound vehicles 430 in lanes 464 are waiting. Unlike FIG. 3, in the scenario depicted in FIG. 4, there is no southbound traffic in lanes 462. This allows vehicle 401 to turn left from northbound lanes 461 onto westbound lanes 463 without delay. Consequently vehicles 402 and 405 are able to continue northbound without hindrance. Vehicles 408, 407, 403 and 406, in the right lane also continue northbound without hindrance, allowing for both lanes to utilize the intersection. In one embodiment of the present invention, a no hinder left turn restriction would permit vehicle 401 to make such a left turn. Unlike prior art in which left turns are restricted based on time, vehicle 401 is allowed to make such a turn based on current traffic conditions regardless of the time or day. FIG. 4 also depicts pedestrian walkways 451, 452, 453 and 454. Vehicle 401 is able to turn left additionally because there are no pedestrians in crosswalk 453. In alternative embodiments, eastbound and westbound lanes may consist of a single lane in each direction and there may be no traffic light but only a stop sign for those vehicles. In that case, westbound and eastbound vehicles must yield to all traffic traveling northbound and southbound.

Figure 5:
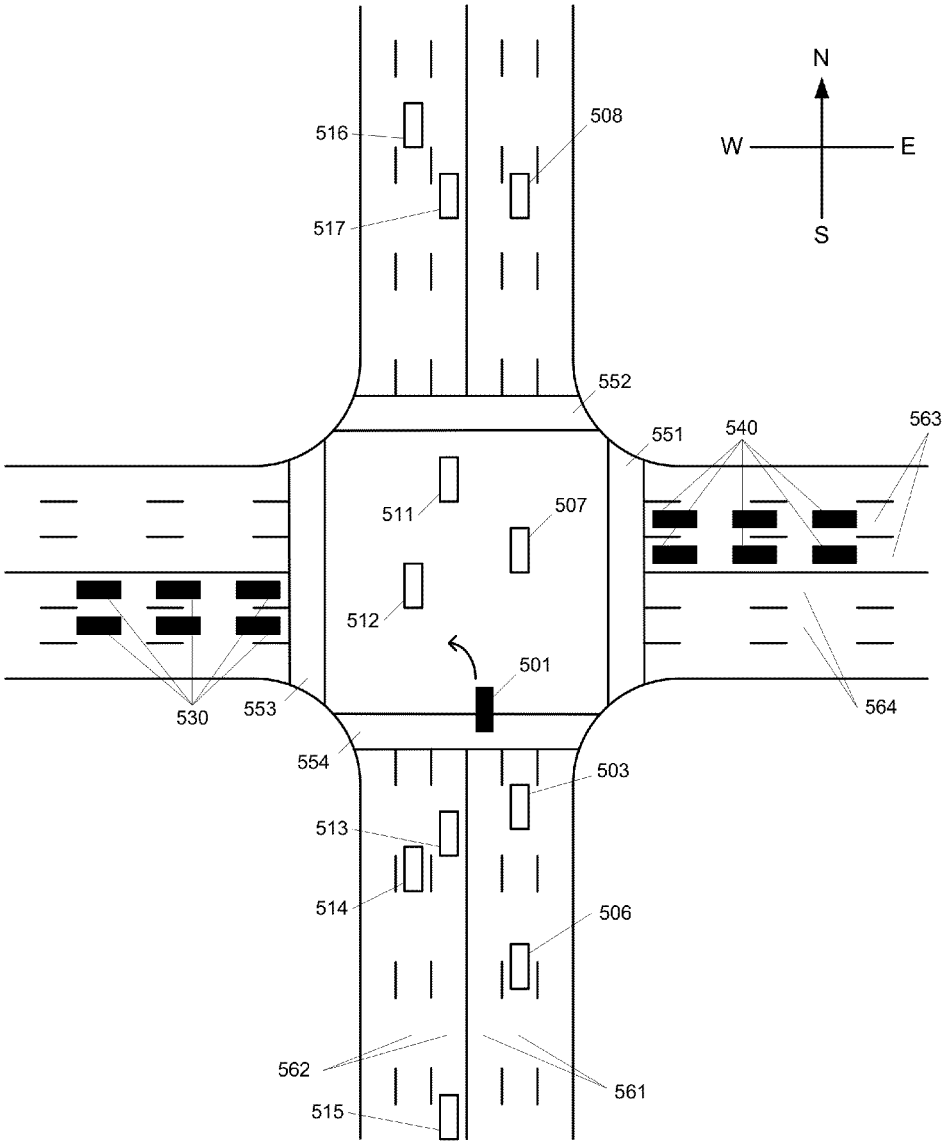
FIG. 5 illustrates another scenario at an intersection in which a vehicle is turning left without hindering other vehicles.

FIG. 5 illustrates a third scenario at an intersection of a design similar to those depicted in FIG. 3 and FIG. 4. As for FIG. 3, westbound vehicles 540 in lanes 563 and eastbound vehicles 530 in lanes 564 are waiting. As for FIG. 3, there is southbound traffic consisting of vehicles 511, 512, 513, 514, 515, 516, 517 in lanes 562. Also vehicle 501 desires to turn left and must therefore wait for this southbound traffic. However, unlike FIG. 3, there are no vehicles waiting behind vehicle 501. Northbound vehicles 503, 506, 507 and 508 are traveling northbound in lanes 561 and are not hindered by vehicle 501 because they are in the right lane. In one embodiment of the present invention, a no hinder left turn restriction would permit vehicle 501 to make such a left turn. Unlike prior art in which left turns are restricted based on time, vehicle 501 is allowed to make such a turn based on current traffic conditions regardless of the time or day. FIG. 5 also depicts pedestrian walkways 551, 552, 553 and 554. Vehicle 501 may also have to wait due to pedestrians in crosswalk 553. In alternative embodiments, eastbound and westbound lanes may consist of a single lane in each direction and there may be no traffic light but only a stop sign for those vehicles. In that case, westbound and eastbound vehicles must yield to all traffic traveling northbound and southbound.

In practice, specific guidelines for what constitutes a hindrance could be based on a number of factors to allow ease of implementation, enforcement and public understanding. Fundamentally, a hindrance is based on on whether other vehicles are substantially impeded in their progress. Specific guidelines might include rules such as:

1. A hindrance may be defined based on the amount of time another vehicle must wait for a turning vehicle, such as a wait of longer than five seconds.

2. A hindrance may be defined such that no hindrance is recognized if there is no opposing traffic and no pedestrians and the vehicle turning is able to do so immediately.

3. A hindrance may be defined based on whether there exists an empty lane to the right; in other words it might not be considered a hindrance if a vehicle behind could easily change lanes to go around the vehicle turning.

4. A hindrance may be defined to allow for multiple vehicles to turn left; in other words it might not be a hindrance if the vehicle behind also wants to turn left.

Figure 2B:
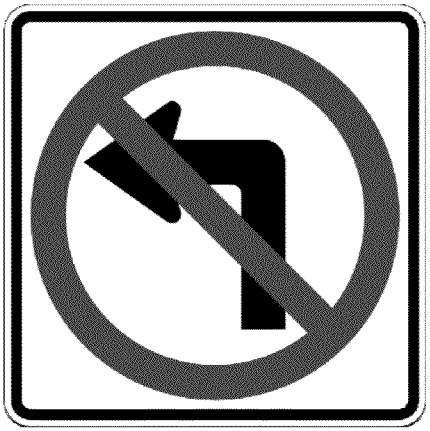
FIG. 2B illustrates a sign denoting a "no hinder" left turn restriction according to another embodiment of the present invention.
Figure 2C:
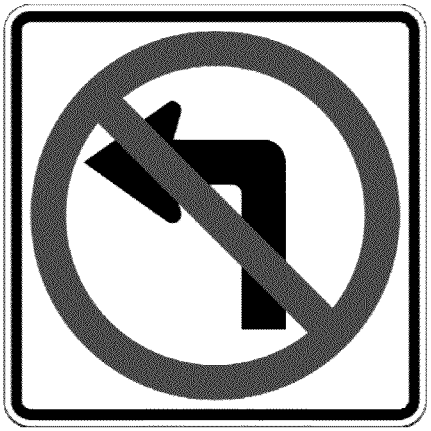
FIG. 2C illustrates a sign denoting a "no hinder" left turn restriction according to another embodiment of the present invention.

In some embodiments, a no hinder left turn can be combined with other turn restrictions. For example, in certain cases it may be desirable that turns are allowed with hindrance at certain times but must be no hinder turns at other times. An example of a sign depicting such a scenario is illustrated in FIG. 2B. This sign means that at the times shown (7:00 AM to 9:30 AM and 3:00 PM to 6:00 PM, Monday through Friday) only no hinder left turns are allowed. At other times, left turns are unrestricted, even if such a turn causes a hindrance. Alternatively, it may be desirable that turns are completely restricted during certain times and allowed as no hinder turns at other times. An example of a sign depicting such a scenario is illustrated in FIG. 2C. This sign means that at the times shown (7:00 AM to 9:30 AM and 3:00 PM to 6:00 PM, Monday through Friday) left turns are not allowed at all, even if such a turn would not cause a hindrance. At other times, left turns are allowed only if they do not cause a hindrance.

In some embodiments, a no hinder turn can be combined with a traffic light in which an arrow allows a protected turn for a certain period of time at the beginning of a sequencing phase. In particular, some intersections have a green arrow allowing a left turn protected from oncoming traffic for a few seconds and once the green arrow goes out, the turn reverts to a traditional left turn yield. In such cases, the turn could revert to a no hinder left turn after the green arrow goes out.

In some embodiments a no hinder turn can be utilized for right turns instead of or in addition to left turns. This might be particularly important where there is no curb lane for right turns and vehicles must wait for pedestrians in a crosswalk. It is also the case the in regions where right-hand drive vehicles are utilized, all of the discussion above with respect to left turns would apply equally to right turns. In some embodiments no hinder turns can be utilized such that vehicles in certain categories are excluded (e.g. buses, bicycles, commercial vehicles, high occupancy vehicles, etc.), and there can be combinations where no hinder restrictions apply to certain categories and not others.

The present invention has been described above in connection with several preferred embodiments. This has been done for purposes of illustration only, and variations of the inventions will be readily apparent to those skilled in the art and also fall within the scope of the invention.

The invention claimed is:

1. A method of controlling traffic at an at grade intersection of a first street and a second street each with at least one lane of vehicle traffic in each direction, wherein a first vehicle traveling in a first direction on said first street desiring to turn on to said second street could potentially impede the progress, based on traffic conditions, of a second vehicle behind said first vehicle also traveling in said first direction on said first street that does not desire to turn onto said second street, said method comprising the step of:

establishing a policy restricting turns at said intersection based on current traffic conditions wherein said policy permits said first vehicle to turn onto said second street if doing so would not substantially impede the progress of said second vehicle, and wherein said policy prohibits said first vehicle from turning onto said second street if doing so would substantially impede the progress of said second vehicle, wherein if prohibited from turning said first vehicle must proceed through said intersection without waiting.

2. The method of claim 1 wherein said policy comprises a left turn restriction.

3. The method of claim 1 wherein said policy comprises a right turn restriction.

4. The method of claim 1 wherein said first street comprises a plurality of lanes in each direction.

5. The method of claim 1 wherein said second street comprises a plurality of lanes in each direction.

6. The method of claim 1 wherein said policy further restricts said first vehicle from turning onto said second street at certain times regardless of traffic conditions.

7. The method of claim 1 wherein said policy further allows said first vehicle to turn onto said second street at certain times regardless of traffic conditions.

* * * * *